US005915655A

United States Patent [19]

Gutowski

[11] Patent Number: 5,915,655

[45] Date of Patent: Jun. 29, 1999

[54] MOBILE PALM HEEL, WRIST AND FOREARM SUPPORT FOR USE WITH KEYBOARDS

[76] Inventor: Walter M. Gutowski, 7610 E. Vista Dr., Scottsdale, Ariz. 85250

[21] Appl. No.: 09/071,147

[22] Filed: Mar. 12, 1998

Related U.S. Application Data

[63] Continuation of application No. 08/673,573, Jul. 1, 1996, abandoned.

[51] Int. Cl.[6] ..... F16M 11/20

[52] U.S. Cl. ..... 248/118.5; 248/118.1; 248/276.1; 248/298.1; 400/715

[58] Field of Search ..... 248/118, 118.1, 248/118.5, 918, 298.1, 276.1; 400/715

[56] References Cited

U.S. PATENT DOCUMENTS

| | | | |
|---|---|---|---|
| 607,675 | 7/1898 | Barr | 248/118.1 |
| 4,576,351 | 3/1986 | Brink | 248/118 |
| 4,863,140 | 9/1989 | Schriner | 248/639 |
| 5,050,826 | 9/1991 | Johnston | 248/118.3 |
| 5,104,073 | 4/1992 | Vanbeek | 248/118.3 |
| 5,108,057 | 4/1992 | Dandy, III | 248/118 |
| 5,135,190 | 8/1992 | Wilson | 248/118.1 |
| 5,158,256 | 10/1992 | Gross | 248/118.3 |
| 5,161,760 | 11/1992 | Terbrack | 242/118 |
| 5,201,485 | 4/1993 | Moss et al. | 248/118 |
| 5,219,136 | 6/1993 | Hassel | 248/118 |
| 5,348,408 | 9/1994 | Gelardi | 400/715 |
| 5,375,800 | 12/1994 | Wilcox | 248/118.1 |
| 5,383,632 | 1/1995 | Shirlin et al. | 248/118.5 |
| 5,386,957 | 2/1995 | Miller | 248/118.5 |
| 5,398,896 | 3/1995 | Terbrack | 248/118.5 |
| 5,402,972 | 4/1995 | Schmidt | 248/118 |
| 5,833,180 | 11/1998 | Baranowski | 248/118 |

*Primary Examiner*—William Stryjewski
*Attorney, Agent, or Firm*—John D. Lister

[57] ABSTRACT

An apparatus includes one or a pair of support platforms for supporting the palm heels, wrists and forearms of an operator relative to a keyboard. The support platforms lie in a plane extending parallel and adjacent to the upper surfaces of the keyboard keys. Where two support platforms are used, the support platforms are mounted on carriages, independently of each other, so that the support platforms can be moved in the plane: a) in a first direction, perpendicular to the keyboard rows between forward positions where forward edges of the support platforms preferably overlap at least a portion of the first row of keyboard keys and b) rearward positions where the forward edges of the support platforms are positioned between the operator and the first row of keyboard keys, and in a second direction, parallel to the keyboard rows, whereby all keyboard keys can be operated by flexion and extension of the operator's fingers with substantially no flexion or extension of the operator's wrists which along with the operator's palm heels and forearms remain supported by and at rest on the upper surfaces of the support platforms during operation of the keyboard.

24 Claims, 7 Drawing Sheets

MOBILE PALM HEEL, WRIST AND FOREARM SUPPORT FOR USE WITH KEYBOARDS

This application is a continuation of application Ser. No. 08/673,573, filed Jul. 1, 1996, now abandoned.

BACKGROUND OF THE INVENTION

The present invention relates to a mobile hand, wrist and forearm support for use with computer, typewriter and similar keyboards and, in particular, to a mobile hand, wrist and forearm support for preventing carpal tunnel syndrome, tendinitis, neck and shoulder strain, and other repetitive strain and/or sprain injuries when using keyboards, and for enabling operators with motor control disabilities to use keyboards.

Known supports for keyboard operators do not provide the necessary support and mobility for the operator's hands, wrists and forearms to enable the operator to easily and effortlessly reach all of the keys of the keyboard with his/her fingers without causing undue flexion extension movement of the wrist.

A number of supports for keyboard operators, such as those disclosed in U.S. Pat. Nos. 5,104,073, 5,219,136, 5,348,408, 5,356,099, 5,375,800, and 5,402,972, provide supports which are positioned between the keyboard and the operator and, once positioned, essentially remain fixed while the operator slides his/her hand, wrist or forearm over the fixed support. Typically, these fixed supports are spaced outwardly from the front of the keyboard and, as the operator reaches for certain keys, especially for keys in one of the back rows such as the function keys, the heel of the palm and frequently the wrist of the operator are no longer directly supported by the fixed support.

A support for keyboard operators, such as shown in U.S. Pat. No. 5,050,826, is also positioned between the keyboard and the operator and, while the support pads 20 move laterally, the heel of the palm and the wrist of the operator are no longer directly supported when the operator reaches for keys in back rows of keys.

A support for keyboard operators, such as shown in U.S. Pat. No. 5,108,057, is positioned over the keyboard, as shown in FIG. 5, with one of the transverse support bars for the hand rests over the keyboard. The positioning of the transverse support bars over the keyboard raises the hands of the operator relative to the keys of the keyboard and the use of extenders, such as extender 44, to help the operator reach the forward row(s) of keys, is suggested. However, even as shown with an extender, the operator could not conveniently reach key 46 or the extender 44 since the operator's thumb can not pass through the transverse support bar 18.

Another form of support for keyboard operators is shown in U.S. Pat. No. 5,158,256. This support includes a pair of wrist pads 54 and 56 which are positioned between the operator and the keyboard, can be move laterally, be adjusted vertically and pivot about screw 68 as shown in FIG. 4. However, as the operator reaches for certain keys, especially for keys in one of the back rows such as the function keys, the heel of the palm and, probably, the wrist of the operator would no longer be directly supported by the fixed support.

U.S. Pat. No. 5,161,760, shows another form of operator support which includes a pair of pivotally mounted extensible bars 24 and 26 with support pads 68 and upwardly biased handles 58 rotatably mounted on the ends of the extensible bars.

U.S. Pat. No. 5,383,632, shows a support for wrists and forearms that includes two arm rests that can be positioned in front of a platform which supports a keyboard.

U.S. Pat. No. 5,386,957, shows a hand support wherein the keyboard is placed within a frame and the hand support 14 is slidably mounted on transverse bars 18 which in turn are slidably mounted on bars 24 so that the entire hand support 14 with its mounting blocks or gliders 22 can pass, in an elevated horizontal plane, over the keyboard so that one finger digit of the operator can contact the keys on the keyboard.

SUMMARY OF THE INVENTION

The support apparatus of the present invention for supporting the palm heels, wrists and forearms of keyboard operators solves the problems of the prior art by providing mobile support surfaces that permit the keyboard operator to reach all of the keys on a keyboard by flexion and extension of the operator's fingers and no or substantially no flexion or extension of the operator's wrists which along with the operator's palm heels and forearms are supported by and remain at rest on the mobile support surfaces.

In one embodiment of the apparatus of the present invention, the apparatus includes a pair of support platforms for supporting the palm heels, wrists and forearms of an operator relative to a keyboard. The support platforms lie in a plane extending parallel and adjacent to the upper surfaces to the keyboard keys and have thin forward edge portions which permit the support platforms to extend out over the keys in this plane with the support surfaces of the platforms preferably spaced only about 3/16 to about 1/4 an inch above the upper surfaces of the keys. Where two support platforms are used, the support platforms are mounted, for movement independent of each other, on carriages of a carriage assembly so that the support platforms can be moved in the aforementioned plane: a) in a first direction, perpendicular to the keyboard rows between forward most positions where forward edges of the support platforms preferably overlap at least a portion of the first row of keyboard keys and rearward most positions where the forward edges of the support platforms are preferably positioned between the operator and the first row of keyboard, at least one half of an inch from the first row of keyboard keys, and b) in a second direction, parallel to the rows of keyboard keys, preferably for the entire lengths of the rows of keyboard keys. Thus, with the present invention, all keyboard keys can be operated by flexion and extension of the operator's fingers with substantially no flexion or extension of the operator's wrists which along with the operator's palm heels and forearms remain supported by and at rest on the upper surfaces of the support platforms during operation of the keyboard.

Preferably, the carriage assembly is positioned between the keyboard and the operator so that the level of the support platforms can be maintained in a plane immediately above the upper surfaces of the keyboard keys. For ease of movement, it is preferred to mount the support platforms on wheeled carriages in the carriage assembly. However, the carriages can be slidably mounted on support rods or other means that permit the desired movement of the support platforms across the keyboard in a plane immediately above and parallel or substantially parallel to the upper surfaces of the keyboard keys so that the upper surfaces of a the support platforms are preferably spaced only about 3/16 to about 1/4 of an inch above a plane containing the upper surfaces of the keyboard keys.

In another embodiment of the present invention, a single support platform is used rather than the two support platforms discussed above. By using a single support platform, that is wide enough to support both palm heels, wrists and forearms of the operator, one arm of the operator can be used to move both hands across the keys of the keyboard. Thus, an operator with a partial disability can use one arm to move both hands over the keyboard so that the operator can still operate the keyboard keys by flexing and extending the fingers of both hands with little or no flexion or extension movements of either wrist.

DESCRIPTION OF THE PREFERRED EMBODIMENTS

FIGS. 1–4 show a preferred embodiment 20 of the palm heel, wrist and forearm support apparatus of the present invention positioned in front of a typical computer keyboard 22. While a computer keyboard is shown, the palm heel, wrist and forearm support apparatus of the present invention can be used with other keyboards, such as but not limited to, typewriter keyboards, calculator keyboards and similar keyboards.

Figure 12:
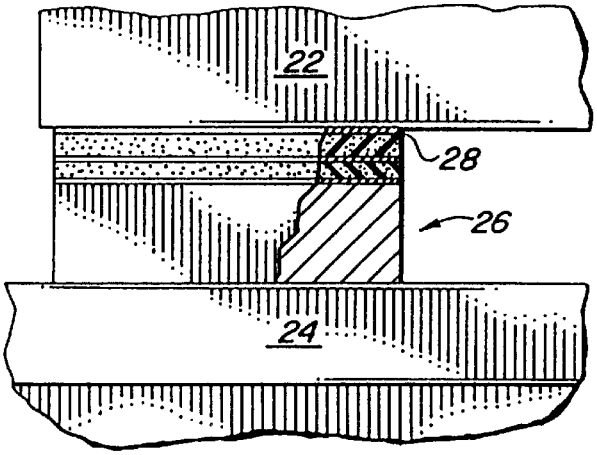
FIG. 12 is an enlarged view of the keyboard support shown in FIG. 2.
Figure 13:
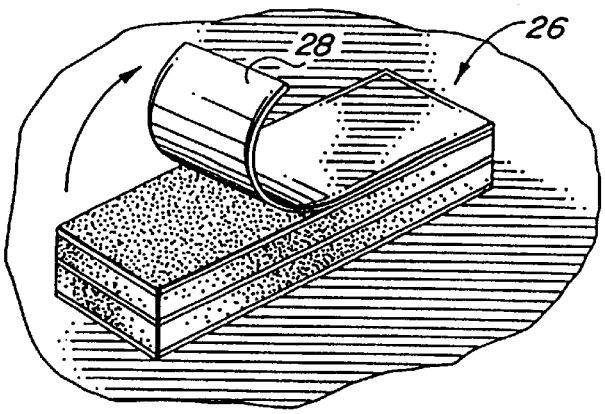
FIG. 13 is a view of the keyboard support of FIG. 11 with a layer partially removed.

The palm heel, wrist and forearm support apparatus 20 is, preferably, mounted on and secured to a base plate 24 by adhesives, screws or other fasteners, not shown, or is integral with the base plate 24 which also carries or supports the keyboard 22. The base plate 24 can be made of a polymeric sheet material, wood, metal or the like, but preferably is made of a polymeric sheet material. The base plate 24 is preferably provided with keyboard support pads 26, such as the pad 26 shown in FIGS. 12 and 13, upon which the keyboard 22 is positioned relative to the palm heel, wrist and forearm support apparatus 20. As shown in FIGS. 12 and 13, surface layers 28 of the base plate pads 26 can be removed or peeled away from or added to the pads 26 to regulate the height of the plane containing the upper surfaces 30 of the keyboard keys 32 relative to the palm heel, wrist and forearm support apparatus of the present invention. An example of one type of surface layer 28 that can be used on the support pads 26 is a sheet, e.g. rubber or plastic, with an anti-skid upper surface and a lower surface coated with a pressure sensitive adhesive. When not in use the lower surfaces of the surface layer sheets could be covered with a release sheet so that the surface layers 28 can be reused if necessary.

As shown in FIGS. 1–4, the palm heel, wrist and forearm support apparatus 20 includes a pair of support platforms 34 and 36; a pair of primary carriages 38 and 40 on which the support platforms 34 and 36 are mounted; a pair of secondary carriages 42 and 44 on which the primary carriages 38 and 40 are mounted; and a base track assembly 46 on which the secondary carriages 42 and 44 are mounted. The above components of the palm heel, wrist and forearm support assembly 20 can be made of polymeric materials (e.g. molded plastics), metals (e.g. aluminum, stainless steel) or similar materials.

The left and right support platforms 34 and 36 of the palm heel, wrist and forearm support apparatus 20 can be moved in both the "X" direction (perpendicular to the keyboard 22 and the rows 48 of keyboard keys) and the "Y" direction (parallel to the keyboard 22 and the rows 48 of keyboard keys). Preferably, the support platforms 34 and 36 are made of a thin sheet material about ⅛ of an inch thick.

The support platforms 34 and 36 are sized to comfortably support the palm heels, wrists and forearms of the keyboard operator and typically have a length in the "X" direction of about seven and one half inches, preferably extending about one half of the way or more from the wrist to the elbow of the keyboard operator, and a width in the "Y" direction of about four and one half inches. The forward edges 50 and 52 of the support platforms 34 and 36 can be somewhat rounded, but preferably the forward edges 50 and 52 of the support platforms 34 and 36 are substantially straight and extend generally in the "Y" direction or parallel to the key rows 48. If desired, the inside ends of the forward edges 50 and 52 can be cut away or configured, for example, as shown by dashed lines 50*a* and 52*a* in FIG. 1, to facilitate the movement of the operators thumbs.

The outside lateral edges 54 and 56 and the inside lateral edges 58 and 60 of the support platforms 34 and 36 are preferably inclined inwardly toward the forward edges 50 and 52 of the support platforms, e.g. at an angle of about 15° to the "X" direction. Since the forearms of the keyboard operator are also going to be inclined inwardly toward the keyboard 22, the angular orientation of the lateral edges 54, 56, 58 and 60 reduces the surface area of the support platforms 34 and 36 and saves on material costs without lessening the support provided to the palm heels, wrists and forearms of the keyboard operator. The configurations of the trailing edges 62 and 64 of the support platforms 34 and 36 may vary. However, all of the corners of the support platforms 34 and 36 are preferably rounded to prevent the support platforms from snagging onto the keyboard operator's clothing.

The support platforms 34 and 36 are mounted on primary carriages 38 and 40 of a carriage assembly. As shown in FIGS. 1–4, the primary carriages 38 and 40 each include a pair of frame members or bars 66, 68 and 70, 72 integral with or secured to the undersides of the support platforms 34 and 36 and extending in the a "X" direction. Each frame member has a pair of wheels or rollers 74, rotatably mounted thereon. The wheels or rollers 74 are received in tracks 76 of the secondary carriages 42 and 44 and preferably have annular flanges 75 to help keep the wheels properly aligned in the tracks 76.

Figure 1:
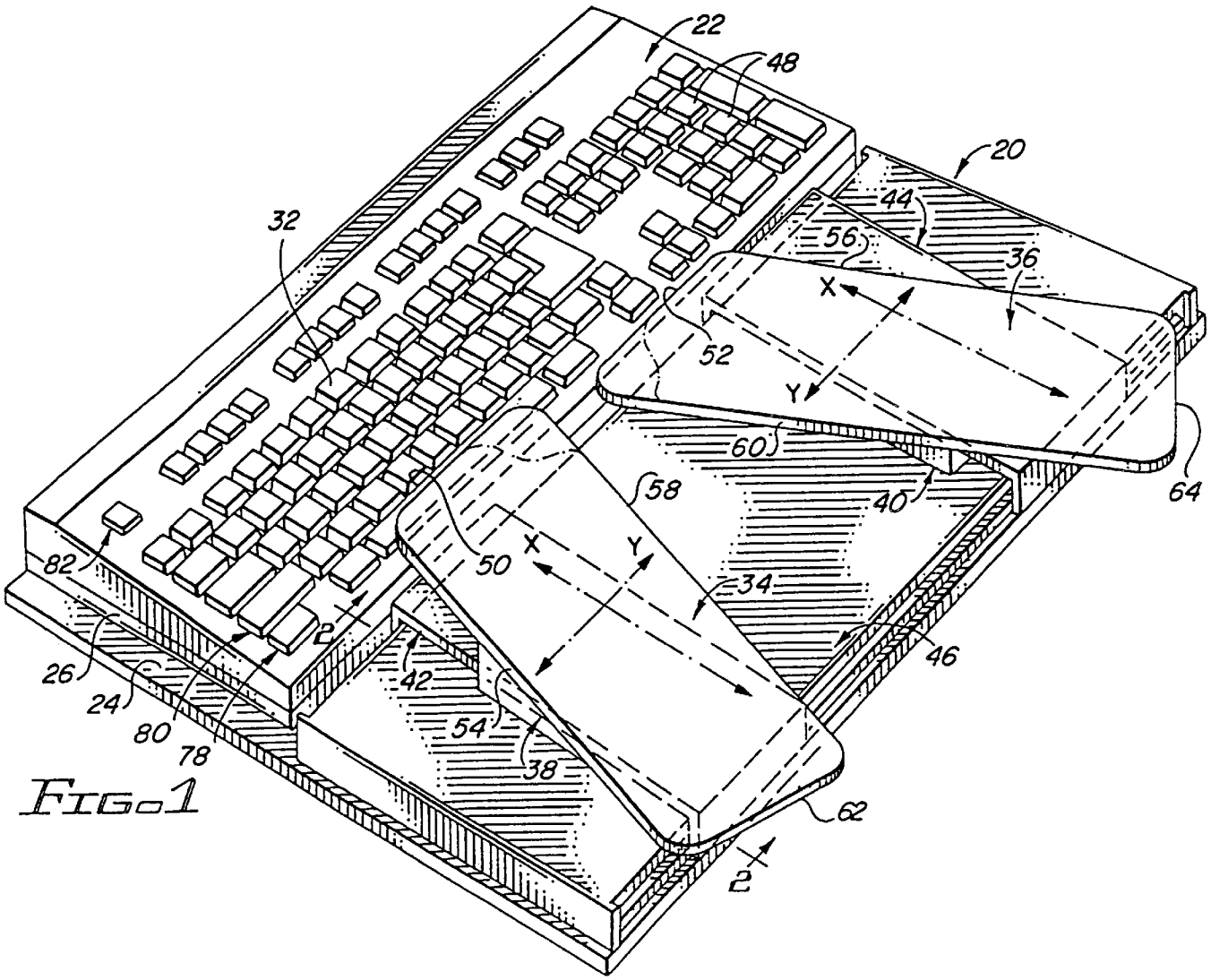
FIG. 1 is a perspective view of a preferred embodiment of the mobile hand, wrist and forearm support of the present invention positioned before a typical computer keyboard.
Figure 2:
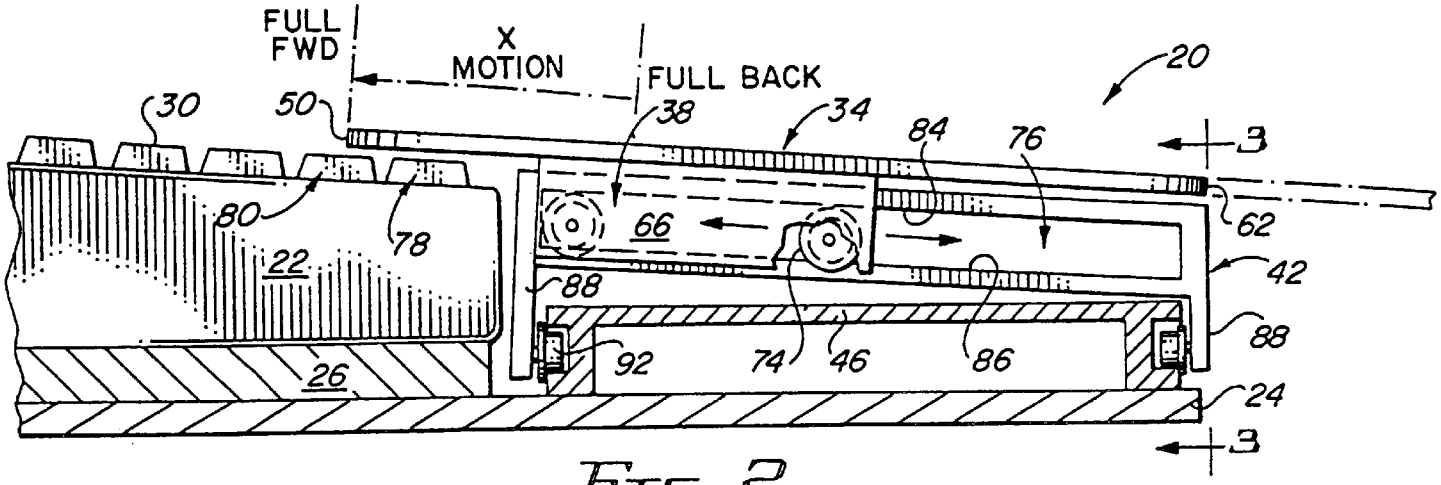
FIG. 2 is a section through the mobile hand, wrist and forearm support of FIG. 1 taken substantially along lines 2—2 of FIG. 1.
Figure 3:
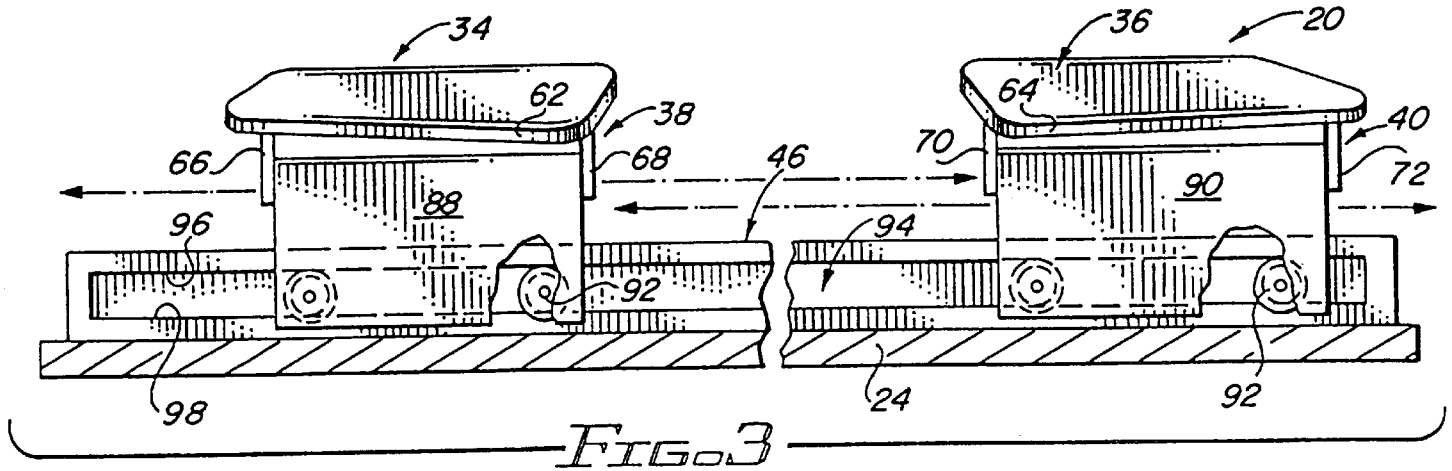
FIG. 3 is a view of the mobile hand, wrist and forearm support of FIG. 1 taken substantially along lines 3—3 of FIG. 2.

The tracks 76 in the secondary carriages 42 and 44 each extend in the "X" direction and are inclined to the horizontal at an angle substantially equal to or, preferably, equal to the angle to the horizontal of the plane containing the upper surfaces 30 of the keyboard keys 32. The upper surfaces of the keyboard keys of computers, typewriters and similar machines lie in planes ranging from a horizontal plane to planes oriented at about 30° to the horizontal but, typically lie in a plane oriented between about 3° and about 7° to the horizontal. With this construction, the support platforms 34 and 36 can be extended over the keyboard keys 32, as shown in FIG. 2, with the undersides of the support platforms immediately above the keyboard keys. Since the thin forward portions of the support platforms 34 and 36 extend forward beyond the frame members 66, 68 and 70, 72, the upper surfaces of the support platforms 34 and 36, upon which the keyboard operator rests his/her palm heels, wrists and forearms, extend in a plane substantially parallel to and preferably parallel to the upper surfaces of the keyboard keys with the palm heels, wrists and forearms of the operator only slightly elevated above the upper surfaces of the keyboard keys 32. The forward portions of the support platforms 34 and 36 extend beyond the frame members 66, 68 and 70, 72 a sufficient distance that the forward edges 50 and 52 of the support platforms can preferably overlap at least a portion of the first row 78 of keyboard keys (typically the space bar row) when the primary carriages 38 and 40 are in their most forward position and, most preferably, at least a portion of the second row 80 of keyboard keys (typically the Z, X, C, V, B, etc. row) when the primary carriages 38 and 40 are in their most forward position. This enables a keyboard operator with small hands to reach the last row 82 of the keyboard keys (typically the function key row) when the support platforms 34 and 36 are in their forward most positions with little or no flexion or extension movements of the wrists and without having to move his/her palm heels, wrists and forearms from the support platforms 34 and 36.

The tracks 76 are preferably in the form of elongated channels with upper and lower surfaces 84 and 86 that confine the wheels or rollers 74 of the primary carriages 38 and 40 so that the support platforms 34 and 36 move in their intended plane of movement and can not be tipped out of their intended plane of movement by pressing down on the forward or trailing edge portions of the support platforms.

The secondary carriages 42 and 44 are each provided with vertical end plates 88 and 90 that support the tracks 76 and have pairs of wheels or rollers 92 rotatably mounted thereon. The wheels or rollers 92 are received within the tracks 94 of the base track assembly 46 and are preferably provided with annular flanges to help keep the wheels properly aligned in the tracks 94. The tracks 94 are preferably in the form of elongated channels with upper and lower surfaces 96 and 98 that confine the wheels or rollers 92 of the secondary carriages 42 and 44 so that the secondary carriages 42 and 44 can not lift out of the tracks 94.

The tracks 76 have a length in the "X" direction that permits the support platforms 34 and 36 to move in the "X" direction between: a) a forward most position where the forward edges 50 and 52 of the support platforms 34 and 36 typically overlap a portion of the keyboard 22, preferably overlap at least a portion of the first row 78 of keyboard keys, and most preferably, overlap at least a portion of the second row 80 of keyboard keys so that even an operator with small hands, such as a child, can reach the last row 82 of keyboard keys with his/her fingers without moving his/her palm heels, wrists or forearms from the support platforms and little or no flexing or extending his/her wrists and b) a rearward most position where the forward edges 50 and 52 of the support platforms do not overlap or extend over the first row of keyboard keys 78 and preferably are spaced in the "X" direction at least one half of an inch and most preferably at least one and one half inches from the operator facing base edges of the keys in the first row 78 of keyboard keys so that the operator can reach the first row 78 of keyboard keys with his/her fingers without moving his/her palm heels, wrists or forearms from the support platforms and with little or no flexing or extending his/her wrists.

By way of example, the length of movement in the "X" direction of the support platforms 34 and 36 ranges from about one to about four inches and most preferably between about three to about three and one half inches to obtain the desired movement in the "X" direction of the support platforms between the forward most and the rearward most positions. The movement of the support platforms in the "X" direction permits the heel palm, wrist and forearm support apparatus of the present invention to be very versatile, e.g. operators with very small hands and short fingers may choose to operate the palm heel, wrist and forearm support apparatus 20 with the support platforms 34 and 36 relatively close to and at the forward most positions and operators with very large hands and long fingers may choose to operate the heel palm, wrist and forearm support apparatus 20 with the support platforms 34 and 36 relatively close to and at the rearward most positions.

The tracks 94 in the base track assembly 46 extend for about the width of the keyboard 22 in the "Y" direction so that the operator can reach all of the keyboard keys in any keyboard row, e.g. about eighteen inches for a typical computer keyboard. The tracks 94 of the base track assembly 46 are spaced out from the front of the keyboard 22 a distance that assures that the movement of the primary carriages 38 and 40 along the tracks 76 of the secondary carriages 42 and 44 can move the support platforms 34 and between the forward most and rearward most positions discussed above.

Figure 4:
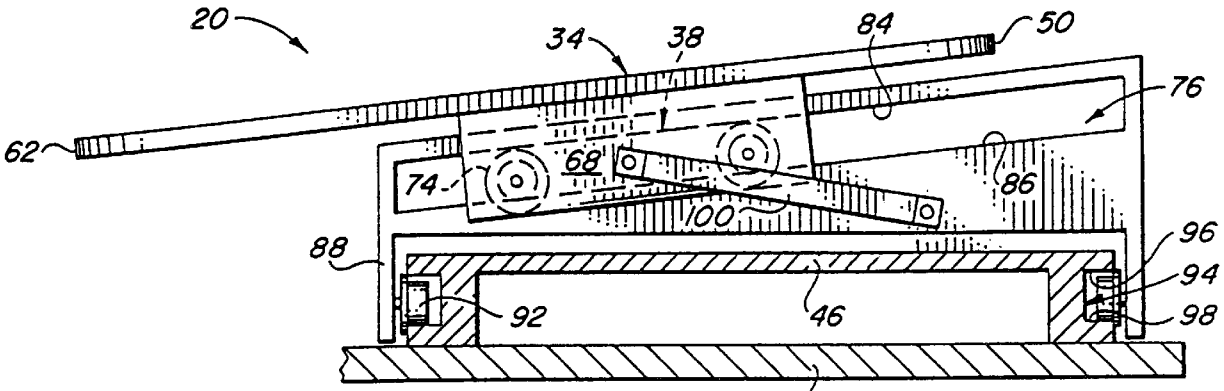
FIG. 4 is a section through the mobile hand, wrist and forearm support of FIG. 1 taken substantially along lines 4—4 of FIG. 3.

In the preferred embodiment the support platforms 34 and 36 are biased toward their forward most positions. As shown in FIG. 4, this can be accomplished by connecting the primary carriages 38 and 40 to the secondary carriages 42 and 44 by means of elastic bands 100. The elastic band 100 shown is in an somewhat extended condition and urges the primary carriage 38 forward. While an elastic band is shown as the biasing means, coil springs or other conventional means for biasing the primary carriages forward can also be used. The use of the biasing means to move the primary carriages 38 and 40 forward when not in use keeps the support platforms 34 and 36 out of the way of the operator when the operator is not using the keyboard 22.

Figure 5:
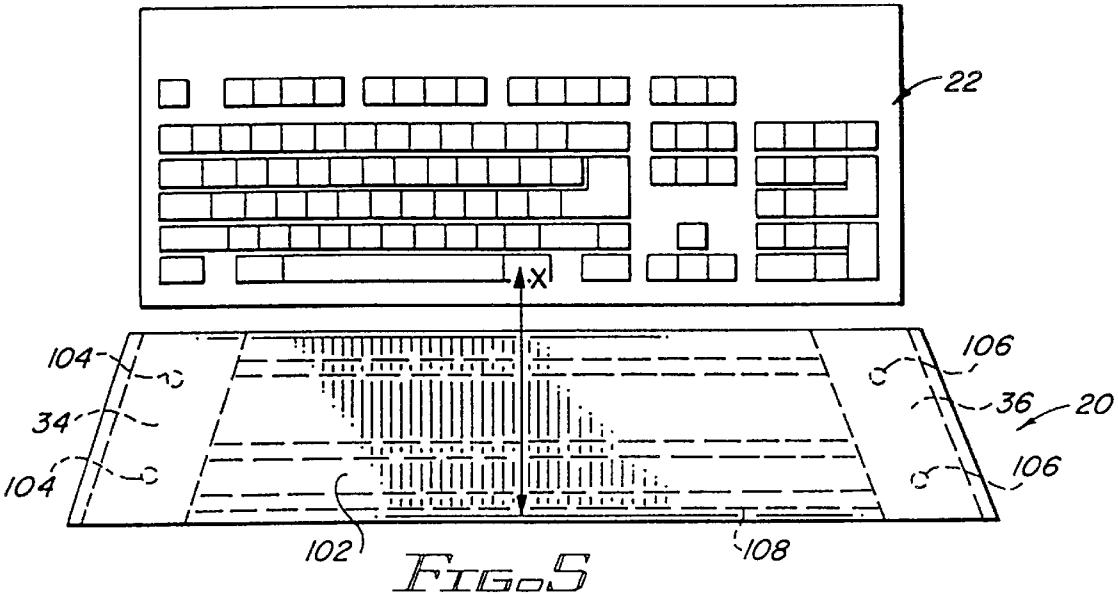
FIG. 5 is a schematic view of the mobile hand, wrist and forearm support of FIG. 1 with a cover plate that allows one hand, wrist and forearm to move the cover plate and the other hand, wrist and forearm of a partially disabled operator fore and aft with respect to the keyboard.

FIG. 5 schematically shows a cover plate 102 that can overlay and be detachably secured to the support platforms 34 and 36. As shown the underside of the cover plate 102 is provided with pair of pegs 104 and 106 which are received within openings in the support platforms 34 and 36 and reinforcing ribs 108 which extend between the inside lateral edges 58 and 60 of the support platforms to keep the cover plate 102 from sagging. Due to the width in the "Y" direction of the cover plate 102, the cover plate 102 can only be moved in the "X" direction. However, for a keyboard operator who is partially disabled, the application of the cover plate 102 to the support platforms enables the operator to use one hand, wrist and forearm to move the fingers of other hand, on the partially disabled side of the operator, over the keyboard in the "X" direction so that the operator can use the fingers of both hands to operate the keyboard. While the pairs of pegs 104 and 106 are shown securing the cover plate 102 to the support platforms 34 and 36, the cover plate could also be secured to the support platforms 34 and 36 by clamps, screws or similar fastening means. It is also contemplated that the cover plate 102 could be substitute for the support plates 34 and 36 by securing the cover plate 102 directly to the primary carriages 38 and 40.

Figure 6:
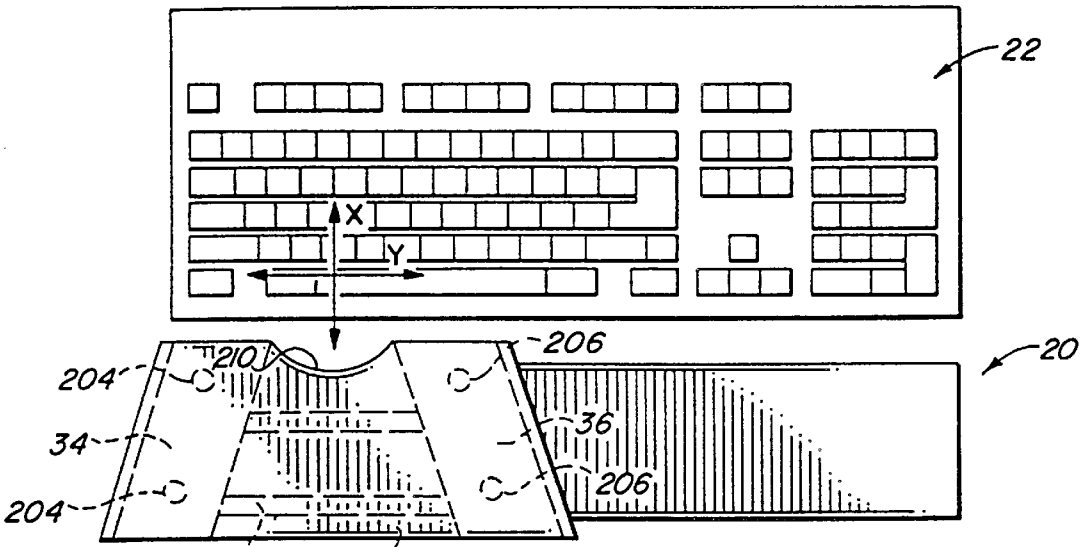
FIG. 6 is a schematic view of the mobile hand, wrist and forearm support of FIG. 1 with a cover plate that allows one hand, wrist and forearm to move the cover plate and the other hand, wrist and forearm of a partially disabled operator both fore and aft and from side to side with respect to the keyboard.

FIG. 6 schematically shows a second cover plate 202 that can overlay and be detachably secured to the support platforms 34 and 36. As shown the underside of the cover plate 202 is provided with pairs of pegs 204 and 206 which are received within openings in the support platforms 34 and 36 and reinforcing ribs 208 which extend between the inside lateral edges 58 and 60 of the support platforms to keep the cover plate 202 from sagging. Typically, the second cover plate separates the support platforms 34 and 36 by about four inches at the forward edges 50 and 52 of the support platforms 34 and 36. Due to the width, in the "Y" direction, of the cover plate 202, the cover plate 202 can be moved in both the "X" direction and the "Y" direction. In addition, the forward edge 210 of the cover plate is preferably provided with a concave edge portion to facilitate the use of the operator's thumbs when operating the keyboard 22. For a keyboard operator who is partially disabled, the application of the cover plate 202 to the support platforms enables the operator to use one hand, wrist and forearm to move the fingers of other hand, on the partially disabled side of the operator, over the keyboard in both the "X" direction and the "Y" direction so that the operator can use the fingers of both hands to operate the keyboard. While the pairs of pegs 204 and 206 are shown securing the cover plate 202 to the support platforms 34 and 36, the cover plate could also be secured to the support platforms 34 and 36 by clamps, screws or similar fastening means. It is also contemplated that the cover plate 202 could be substituted for the support plates 34 and 36 by securing the cover plate 202 directly to the primary carriages 38 and 40.

FIGS. 7–11 show a second embodiment 120 of the palm heel, wrist and forearm support apparatus of the present invention positioned in front of a typical computer keyboard 22. While a computer keyboard is shown, the palm heel, wrist and forearm support apparatus of the present invention can be used with other keyboards, such as but not limited to, typewriter keyboards, calculator keyboards and similar keyboards.

The palm heel, wrist and forearm support apparatus 120 is, preferably, mounted on and secured to a base plate 124 by adhesives, screws or other fasteners, not shown, or is integral with the base plate 124 which also carries or supports the keyboard 22. The base plate 124 can be made of a polymeric sheet material, wood, metal or the like, but preferably is made of a polymeric sheet material. The base plate 124 is preferably provided with keyboard support pads 126 upon which the keyboard 22 is positioned relative to the palm heel, wrist and forearm support apparatus 120. The keyboard support pads 126 are identical to the keyboard support pads 26 shown in FIGS. 12 and 13 and described in connection with the preferred embodiment 20 of this invention and permit the height of the keyboard 22 to be adjusted relative to the palm heel, wrist and forearm support apparatus 120.

As shown in FIGS. 7–11, the palm heel, wrist and forearm support apparatus 120 includes a pair of support platforms 134 and 136; a pair of primary carriages 138 and 140 on which the support platforms 134 and 136 are mounted; a pair of secondary carriages 142 and 144 on which the primary carriages 138 and 140 are slidably mounted; and a base rail assembly 146 on which the secondary carriages 142 and 144 are slidably mounted. The above components of the palm heel, wrist and forearm support apparatus 120 can be made of polymeric materials (e.g. molded plastics), metals (e.g. aluminum, stainless steel) or similar materials.

The left and right support platforms 134 and 136 of the palm heel, wrist and forearm support apparatus 120 can be moved in both the "X" direction (perpendicular to the keyboard 22 and the rows 48 of keyboard keys) and the "Y" direction (parallel to the keyboard 22 and the rows 48 of keyboard keys). Preferably, the support platforms 134 and 136 are made of a thin sheet material about ⅛ of an inch thick.

The support platforms 134 and 136 are sized to comfortably support the palm heels, wrists and forearms of the keyboard operator and typically have a length in the "X" direction of about seven and one half inches, preferably extending about one half of the way or more from the wrist to the elbow of the keyboard operator, and a width in the "Y" direction of about four and one half inches. The forward edges 150 and 152 of the support platforms 134 and 136 can be somewhat rounded, as shown, or the forward edges 150 and 152 of the support platforms 134 and 136 can be substantially straight and extend generally in the "Y" direction or parallel to the key rows 48 with or without cutouts for the thumbs, such as platforms 34 and 36 of FIG. 1. The outside lateral edges 154 and 156 and the inside lateral edges 158 and 160 of the support platforms 134 and 136 are preferably inclined inwardly toward the forward edges 150 and 152 of the support platforms, e.g. at an angle of about 15° to the "X" direction. Since the forearms of the keyboard operator are also going to be inclined inwardly toward the keyboard 22, the angular orientation of the lateral edges 154, 156, 158 and 160 reduces the surface area of the support platforms 134 and 136 and saves on material costs without lessening the support provided to the palm heels, wrists and forearms of the keyboard operator. The configurations of the trailing edges 162 and 164 of the support platforms 134 and 136 may vary. However, all of the corners of the support platforms 134 and 136 are preferably rounded to prevent the support platforms from snagging onto the keyboard operator's clothing.

Figure 8:
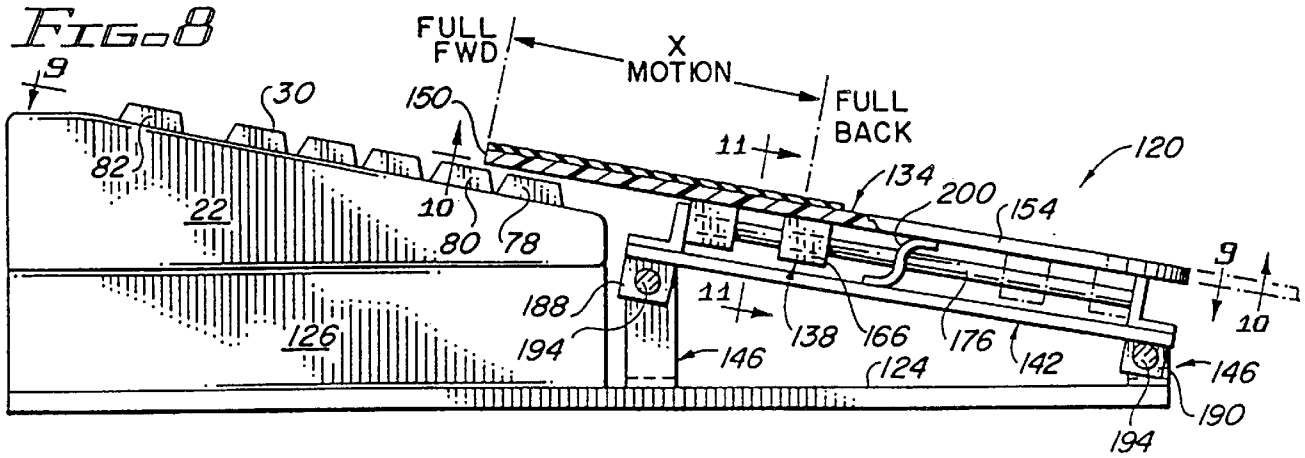
FIG. 8 is a section through the mobile hand, wrist and forearm support of FIG. 7 taken substantially along lines 8—8 of FIG. 7.
Figure 7:
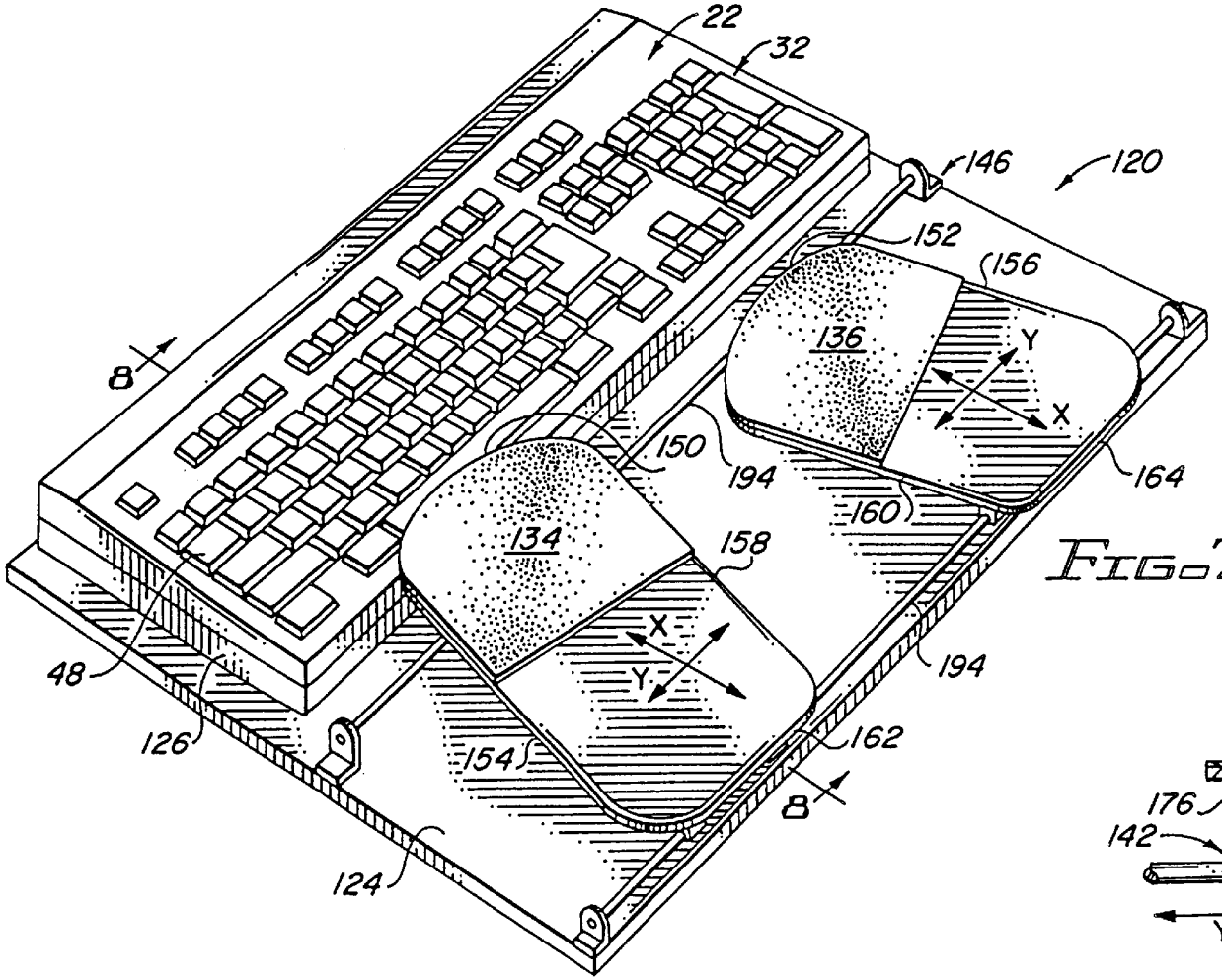
FIG. 7 is a perspective view of a second embodiment of the mobile hand, wrist and forearm support of the present invention positioned before a typical computer keyboard.
Figure 11:
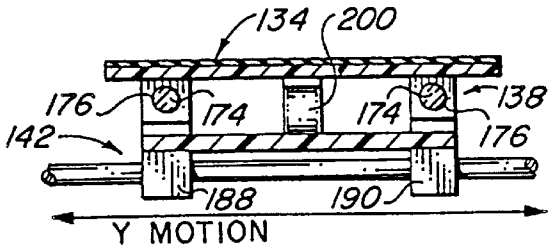
FIG. 11 is a section of a support platform and carriage assembly taken substantially along lines 11—11 of FIG. 8.
Figure 9:
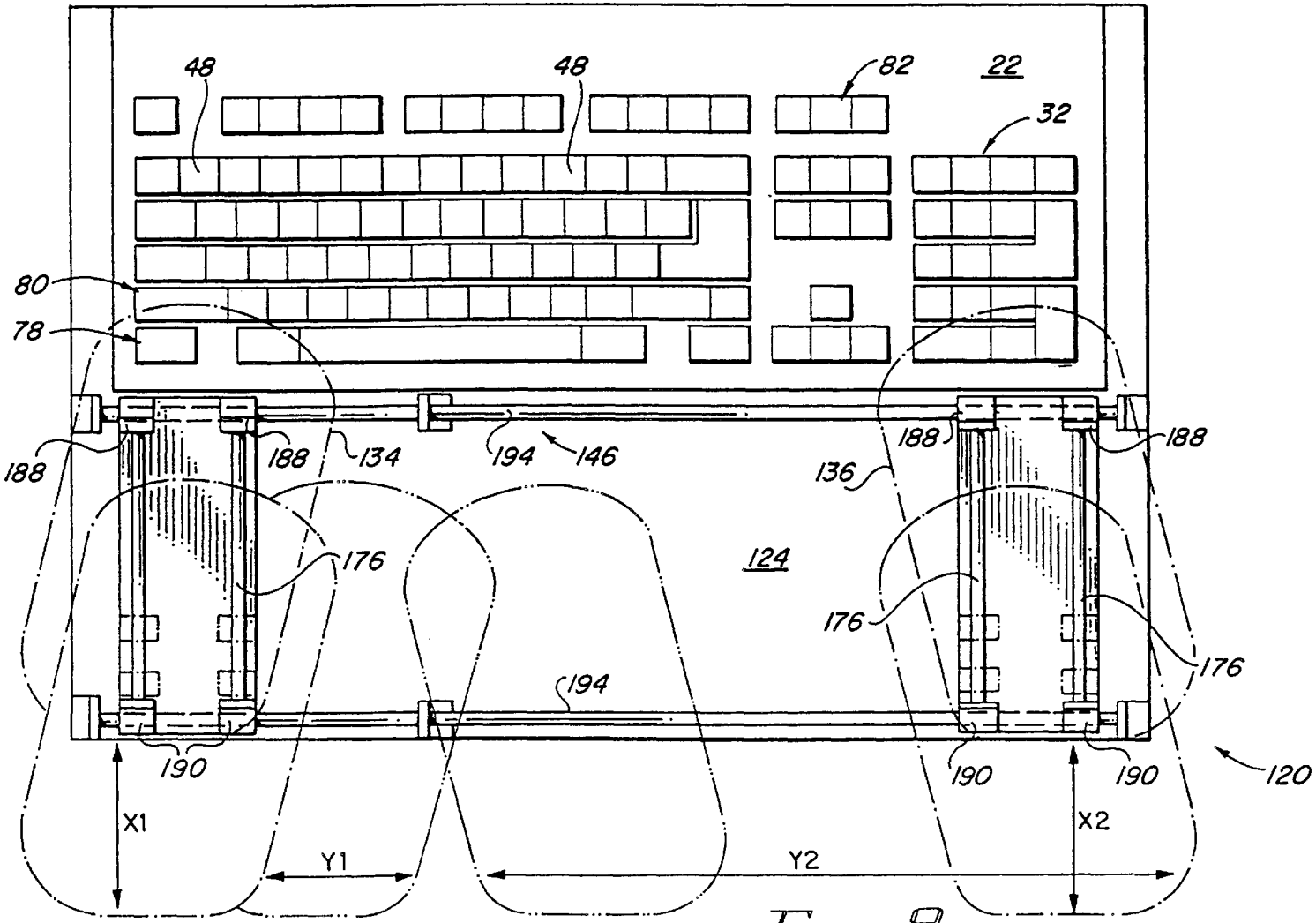
FIG. 9 is a plan view of the mobile hand, wrist and forearm support of FIG. 7 taken substantially along lines 9—9 of FIG. 8.
Figure 10:
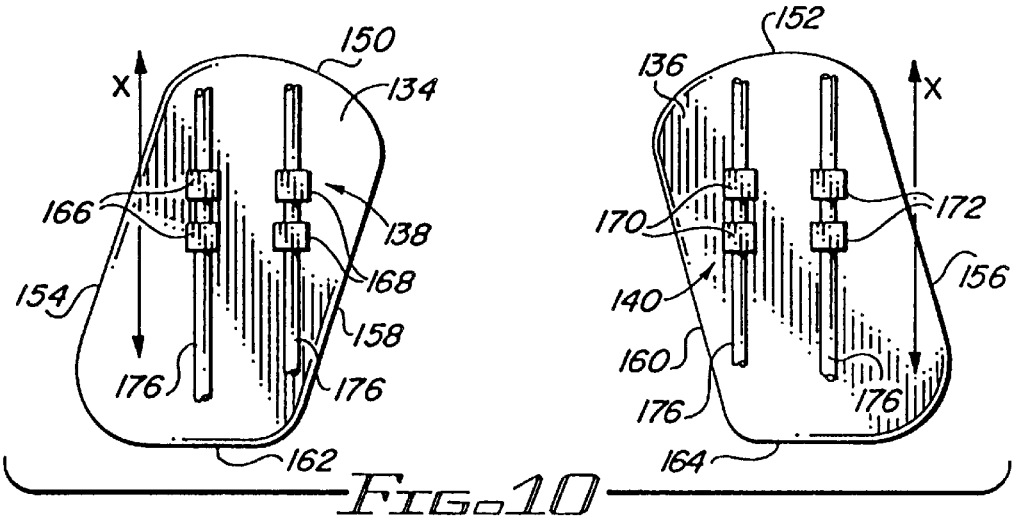
FIG. 10 is an underside view of the hand, wrist and forearm support platforms of the hand, wrist and forearm support of FIG. 7 taken substantially along lines 10—10 of FIG. 8.

The support platforms 134 and 136 are mounted on primary the carriages 138 and 140. As best shown in FIGS. 8, 10 and 11, the primary carriages 138 and 140 each include a two pair of sleeve members 166, 168 and 170, 172 integral with or secured to the undersides of the support platforms 134 and 136 and having bores 174 extending therethrough in the "X" direction. The bores 174 of each sleeve member are slidably mounted on parallel support rails 176 of the secondary carriages 142 and 144. The parallel support rails 176 of the secondary carriages 142 and 144 extend in the "X" a direction and are inclined to the horizontal at an angle substantially equal to or, preferably, equal to the angle to the horizontal of the plane containing the upper surfaces 30 of the keyboard keys 32. With this construction, the support platforms 134 and 136 can be extended over the keyboard keys 32, as shown in FIGS. 7 and 8, with the undersides of the support platforms immediately above the keyboard keys. Since the thin forward portions of the support platforms 134 and 136 extend forward beyond the sleeve members 166, 168 and 170, 172, the upper surfaces of the support platforms 134 and 136, upon which the keyboard operator rests his/her palm heels, wrists and forearms, extend in a plane substantially parallel to and preferably parallel to the upper surfaces of the keyboard keys with the palm heels, wrists and forearms of the operator only slightly elevated above the upper surfaces of the keyboard keys 32. The forward portions of the support platforms 134 and 136 extend beyond the sleeve members 166, 168 and 170, 172 a sufficient distance that the forward edges 150 and 152 of the support platforms can preferably overlap at least a portion of the first row 78 of keyboard keys (typically the space bar row) when the primary carriages 138 and 140 are in their most forward position and, most preferably, at least a portion of the second row 80 of keyboard keys (typically the Z, X, C, V, B, etc. row) when the primary carriages 138 and 140 are in their forward most position. This enables a keyboard operator with small hands to reach the last row 82 of the keyboard keys (typically the function key row) without having to move his/her hands from the support platforms 134 and 136 when the support platforms 134 and 136 are in their forward most positions with little or no flexion or extension movements of the wrists and without having to move his/her palm heels, wrists and forearms form the support platforms 134 and 136.

The bores 174 in the sleeve members and support rails 176 are preferably coated or treated with teflon or some other material to facilitate the gliding movement of the support platforms 134 and 136 in the "X" direction. With the support rails 176 passing through the bores 174, the support platforms 134 and 136 can not be tipped out of their intended plane of movement by pressing down on the forward or trailing edge portions of the support platforms.

The undersides of the secondary carriages 142 and 144 are each provided with pairs of sleeve members 188 and 190 that are slidably mounted on parallel support rails 194 of the base rail assembly 146. The support rails 194 extend in the "Y" direction and with the support rails passing through the sleeve members 188 and 190 of the secondary carriages 142 and 144, the secondary carriages 142 and 144 can not lifted out of their intended plane of motion.

The support rails 176 have a length in the "X" direction that permits the support platforms 134 and 136 to move in the "IX" direction between: a) a forward most position where the forward edges 150 and 152 of the support platforms 134 and 136 typically overlap a portion of the keyboard 22, preferably overlap at least a portion of the first row 78 of keyboard keys, and most preferably, overlap at least a portion of the second row 80 of keyboard keys so that the operator can reach the last row of keyboard keys with his/her fingers without moving his/her palm heels, wrists or forearms from the support platforms and little or no flexing or extending his/her wrists and b) a rearward most position where the forward edges 150 and 152 of the support platforms do not extend over the first row of keyboard keys 78 and preferably are spaced in the "X" direction at least one half of an inch and most preferably at least one and one half inches from the operator facing base edges of the keys in the first row 78 of keyboard keys so that the operator can reach the first row 78 of keyboard keys with his/her fingers without moving his/her palm heels, wrists or forearms from the support platforms and with little or no flexing or extending his/her wrists.

By way of example, the length of movement in the "X" direction of the support platforms 134 and 136 ranges from about one to about four inches and most preferably between about three to about three and one half inches to obtain the desired movement in the "X" direction of the support platforms between the forward most and the rearward most positions. The movement of the support platforms in the "X" direction permits the heel palm, wrist and forearm support apparatus of the present invention to be very versatile, e.g. operators with very small hands and short fingers may choose to operate the palm heel, wrist and forearm support apparatus 120 with the support platforms 134 and 136 relatively close to and at the forward most positions and operators with very large hands and long fingers may choose to operate the heel palm, wrist and forearm support apparatus 120 with the support platforms 134 and 136 relatively close to and at the rearward most positions.

The support rails 194 in the base rail assembly 146 extend for about the width of the keyboard 22 in the "Y" direction so that the operator can reach all of the keyboard keys in any keyboard row, e.g. about eighteen inches for a typical computer keyboard. The support rails 194 of the base rail assembly 146 are spaced out from the front of the keyboard 22 a distance that assures that the movement of the primary carriages 138 and 140 along the support rails 176 of the secondary carriages 142 and 144 can move the support platforms 134 and 136 between the forward most and rearward most positions discussed above.

Preferably, the support platforms 134 and 136 are biased toward their forward most positions. As shown in FIGS. 8 and 11, this can be accomplished by connecting the undersides of the support platforms 134 and 136 to the uppersides of the secondary carriages 142 and 144 by means of elastic bands 200. The elastic band 200, shown in FIG. 8, is in an somewhat extended condition and urges the support platform 134 forward. While an elastic band is shown as the biasing means, coil springs or other conventional means for biasing the primary carriages forward can also be used. The use of the biasing means to move the support platforms 134 and 136 forward when not in use keeps the support platforms 134 and 136 out of the way of the operator when the operator is not using the keyboard 22.

The cover plates 102 and 202 shown and described in connection with FIGS. 5 and 6 and the preferred embodiment 20 of the present invention can also be applied in a similar manner to the support platforms 134 and 136 of embodiment 120.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A support apparatus for supporting the palm heels, wrists and forearms of an operator to minimize flexion and extension of the operator's wrists when operating keyboards, comprising:

first and second support platform means for supporting the palm heels, wrists and forearms of an operator relative to a keyboard; said support platform means having forward edges and rear edges and upper surfaces which extend about one half of the way or more from the wrist to the elbow upon which the operator's palm heels, wrists and forearms rest while operating the keyboard keys; said upper surfaces of said support platform means lying in a first plane substantially parallel to and adjacent a second plane containing upper surfaces of keys of the keyboard so that the operator can operate the keyboard keys by flexion and extension of the fingers with substantially no flexion or extension of operator's wrists which along with the operator's palm heels and forearms remain essentially at rest on said upper surfaces of said support platform means while the keyboard is being operated; and carriage means positioned between the operator and the keyboard for supporting said first and second support platform means independently of each other; said carriage means being movable between forward most positions and rearward most positions between the keyboard and the operator so that said first and second support platform means can be moved in said first plane in a first direction perpendicular to the keyboard rows between forward most positions where said forward edges of said first and second support platform means overlap a portion of the keyboard so that the operator can reach a last row of keyboard keys while the operator's palm heels, wrists and forearms remain at rest on said upper surfaces of said support platform means and rearward most positions where the operator can reach a first row of keyboard keys while the operator's palm heels, wrists and forearms remain at rest on said upper surfaces of said support platform means and in a second direction parallel to the keyboard rows whereby all keyboard keys can be operated by flexion and extension of the operator's fingers with substantially no flexion or extension of the operator's wrists which along with the operator's palm heels and forearms remain at rest on said upper surfaces of said support platforms means.

2. The support apparatus according to claim 1, wherein: said forward edges of said first and said second support platform means overlap only at least a portion of a first row of keyboard keys when said first and said second support platform means are in their forward most positions.

3. The support apparatus according to claim 1, wherein: said forward edges of said first and said second support platform means overlap only at least a portion of a second row of keyboard keys adjacent said first row of keyboard keys when said first and said second support platform means are in their forward most positions.

4. The support apparatus according to claim 1, wherein: said carriage means for supporting said first and said second support platform means can move said first and said second support platform means between about one inch and about four inches in said direction perpendicular to the rows of keyboard keys; and said forward edges of said first and second support platform means extend no farther than to overlap a second row of keyboard keys adjacent said first row of keyboard keys when said first and second support platform means are in their forward most positions.

5. The support apparatus according to claim 1, wherein: said carriage means comprises a first pair of carriages carrying said support platform means secured to the undersides of said support platform means and movable in said first direction; and a second pair of carriages carrying said first pair of carriages and movable in said second direction; and a base member carrying said second pair of carriages.

6. The support apparatus according to claim 5, wherein: said carriages are wheeled carriages.

7. The support apparatus according to claims 5, wherein: said first pair of carriages have means biasing said first pair of carriages toward said forward most positions so that said support platforms rest in said first positions when said support apparatus in not in use.

8. The support apparatus according to claim 5, wherein: said base member has a keyboard support means for supporting the keyboard relative to said support apparatus and adjusting the spacing between said first and second planes.

9. A support apparatus for supporting the palm heels, wrists and forearms of an operator to minimize flexion and extension of the operator's wrists when operating keyboards, comprising:

a support platform means for supporting the palm heels, wrists and forearms of an operator relative to a keyboard; said support platform means having a forward edge, a rear edge, and side edges and an upper surface which extends about one half of the way or more from the wrist to the elbow upon which the operator's palm heels, wrists and forearms rest while operating the keyboard keys; said upper surface of said support platform means lying in a first plane substantially parallel to and adjacent a second plane containing upper surfaces of the keyboard keys so that the operator can operate the keyboard keys by flexion and extension of the fingers with substantially no flexion or extension of operator's wrists which along with the operator's palm heels and forearms remain essentially at rest on said upper surface of said support platform means; and carriage means positioned between the operator and the keyboard for supporting said support platform means; said carriage means being movable between a forward most position and a rearward most position between the keyboard and the operator so that said support platform means can be moved in said first plane in a first direction perpendicular to the keyboard rows between a forward most position where said forward edge of said support platform means overlaps a portion of the keyboard so that the operator can reach a last row of keyboard keys while the operator's palm heels, wrists and forearms remain at rest on said upper surface of said support platform means and a rearward most position where the operator can reach a first row of keyboard keys while the operator's palm heels, wrists and forearms remain at rest on said upper surface of said support platform means and in a second direction parallel to the keyboard rows whereby all keyboard keys can be operated by flexion and extension of the operator's fingers with substantially no flexion or extension of the operator's wrists which along with the operator's palm heels and forearms remain at rest on said upper surface of said support platform means.

10. The support apparatus according to claim 9, wherein: said forward edge of said support platform means overlaps only a first row of keyboard keys when said support platform means is in its forward most position.

11. The support apparatus according to claim 9, wherein: said forward edge of said support platform means overlaps only a second row of keyboard keys adjacent said first row of keyboard keys when said support platform means is in its forward most position.

12. The support apparatus according to claim 9, wherein: said carriage means for supporting said support platform means can move said support platform means between about one inch and about four inches in said direction perpendicular to the rows of keyboard keys; and said forward edge of said support platform means extends no farther than to overlap a second row of keyboard keys adjacent said first row of keyboard keys when said support platform means is in its forward most position.

13. The support apparatus according to claim 9, wherein: said carriage means comprises a first pair of carriages carrying said support platform means secured to the underside of said support platform means and movable in said first direction; and a second pair of carriages carrying said first pair of carriages and movable in said second direction; and a base member carrying said second pair of carriages.

14. The support apparatus according to claim 13, wherein: said carriages are wheeled carriages.

15. The support apparatus according to claim 13, wherein: said first pair of carriages have means biasing said first pair of carriages toward said forward most positions so that said support platforms rest in said first positions when said support apparatus in not in use.

16. The support apparatus according to claim 13, wherein: said base member has a keyboard support means for supporting the keyboard relative to said support apparatus and adjusting the spacing between said first and second planes.

17. A support apparatus for supporting the palm heels, wrists and forearms of an operator to minimize flexion and extension of the operator's wrists when operating keyboards, comprising:

a support platform means for supporting the palm heels, wrists and forearms of an operator relative to a keyboard; said support platform means having a forward edge, a rear edge, and side edges and an upper surface which extends about one half of the way or more from the wrist to the elbow upon which the operator's palm heels, wrists and forearms rest while operating the keyboard keys; said upper surface of said support platform means lying in a first plane substantially parallel to and adjacent a second plane containing upper surfaces of the keyboard keys so that the operator can operate the keyboard keys by flexion and extension of the fingers with substantially no flexion or extension of operator's wrists which along with the operator's palm heels and forearms remain on said upper surface of said support platform means; and carriage means positioned between the operator and the keyboard for supporting said support platform means; said carriage means being movable between a forward most position and a rearward most position between the keyboard and the operator so that said support platform means can be moved in said first plane in a first direction perpendicular to the keyboard rows between a forward most position where said forward edge of said support platform overlaps a portion of the keyboard so that the operator can reach a last row of keyboard keys while the operator's palm heels, wrists and forearms remain at rest on said upper surface of said support platform means and a rearward position where the operator can reach a first row of keyboard keys while the operator's palm heels, wrists and forearms remain at rest on said upper surface of said support platform means whereby all keyboard keys can be operated by flexion and extension of the operator's fingers with substantially no flexion or extension of the operator's wrists which along with the operator's palm heels and forearms remain on said upper surface of said support platform means.

18. The support apparatus according to claim 17, wherein: said forward edge of said support platform means overlaps only a first row of keyboard keys when said support platform means is in its forward most position.

19. The support apparatus according to claim 17, wherein: said forward edge of said support platform means overlaps only a second row of keyboard keys adjacent said first row of keyboard keys when said support platform means is in its forward most position.

20. The support apparatus according to claim 17, wherein: said carriage means for supporting said support platform means can move said support platform means between about one inch and about four inches in said direction perpendicular to the rows of keyboard keys; and said forward edge of said support platform means extends no farther than to overlap a second row of keyboard keys adjacent said first row of keyboard keys when said support platform means is in its forward most position.

21. The support apparatus according to claim 17, wherein: said carriage means comprises a pair of carriages carrying said support platforms means secured to an underside of said support platform means and movable in said first direction; and a base member carrying said pair of carriages.

22. The support apparatus according to claim 21, wherein: said carriages are wheeled carriages.

23. The support apparatus according to claim 21, wherein: said first pair of carriages have means biasing said first pair of carriages toward said forward most positions so that said support platforms rest in said first positions when said support apparatus in not in use.

24. The support apparatus according to claim 21, wherein: said base member has a keyboard support means for supporting the keyboard relative to said support apparatus and adjusting the spacing between said first and second planes.

* * * * *